US006481157B1

(12) United States Patent
Haake et al.

(10) Patent No.: US 6,481,157 B1
(45) Date of Patent: Nov. 19, 2002

(54) SAFETY DEVICE FOR A CLOSURE INCLUDING A PLURALITY OF CONTACT ELEMENTS

(76) Inventors: Andre Haake, Drosselstiege 28, Stadlohn D-48703 (DE); Oliver Haake, Eschlohn 24, Sudlohn D-46354 (DE); Patrick Haake, Wullener Strasse 92, Vreden D-48691 (DE)

( * ) Notice: Subject to any disclaimer, the term of this patent is extended or adjusted under 35 U.S.C. 154(b) by 0 days.

(21) Appl. No.: 09/673,586

(22) PCT Filed: Apr. 1, 1999

(86) PCT No.: PCT/DE99/01053

§ 371 (c)(1),
(2), (4) Date: Oct. 18, 2000

(87) PCT Pub. No.: WO99/57401

PCT Pub. Date: Nov. 11, 1999

(30) Foreign Application Priority Data

| | | |
|---|---|---|
| May 2, 1998 | (DE) | 198 19 730 |
| Jun. 26, 1998 | (DE) | 198 28 674 |
| Jul. 16, 1998 | (DE) | 198 31 895 |
| Jul. 28, 1998 | (DE) | 198 33 846 |

(51) Int. Cl.[7] ..... E05F 15/00
(52) U.S. Cl. ..... 49/26; 49/27
(58) Field of Search ..... 49/26, 27, 28; 200/61.43

(56) References Cited

U.S. PATENT DOCUMENTS

| | | | | | |
|---|---|---|---|---|---|
| 2,476,111 | A | * | 7/1949 | Opalek | 49/27 |
| 4,301,621 | A | * | 11/1981 | Houweling | 49/27 |
| 5,929,406 | A | * | 7/1999 | Thiel | 200/61.43 |
| 5,942,966 | A | * | 8/1999 | Haake et al. | 337/4 |
| 5,962,825 | A | * | 10/1999 | Miller | 200/61.43 |

FOREIGN PATENT DOCUMENTS

| | | |
|---|---|---|
| EP | 0 234 523 | 9/1987 |
| FR | 2 135 922 a | 12/1972 |
| WO | WO 97/38199 | 10/1997 |

* cited by examiner

*Primary Examiner*—Gregory J. Strimbu
(74) *Attorney, Agent, or Firm*—Merchant & Gould P.C.

(57) ABSTRACT

A closing edge safety device that consists of a safety strip (1) that has an electric switching device which is made up of a plurality of contact elements (2) that are arranged next to each other in a flexible tube (3). The contact elements (2) can be magnetized, an expander chord (5) can pass through them or they can lie on top of each other as a result of their weight, whereby they are urged to abut one another. When contact between one or more of the contact elements is broken, a signal is generated.

11 Claims, 2 Drawing Sheets

SAFETY DEVICE FOR A CLOSURE INCLUDING A PLURALITY OF CONTACT ELEMENTS

TECHNICAL FIELD

The invention relates to a closing edge safety device.

BACKGROUND

A closing edge safety device is described in FR 21 35 922 A1. In this arrangement, a tube consisting of soft material has arranged inside it balls which preferably consist of steel and have a diameter which is somewhat smaller than the inside diameter of the soft tube, the tube being elastically elongated while it is being filled with the balls. Still in this elongated state, the two openings of the tube are closed with plugs, to which the contact lines are connected. The plugs together with the tensioned tube produce within the tensioned tube the required pretension with which the balls abut one another.

If the balls are moved apart from one another by local deforming pressure, the current is interrupted and a signal is generated.

The known arrangement has not been adopted in practice, since the balls do not center themselves in the soft tube, but are instead displaced with respect to one another to move away from the pretension produced by the tube, so that a straight chain of balls is not obtained in the finally installed state. In this situation, the balls may deform the outer surface of the tube, so that there are difficulties when the tube is installed, but it may also be the case when the local deforming pressure occurs that the uncentered balls prevent the necessary signaling.

In WO/97 38 199 there is a description of a closing edge safety device in which an elastic contact element bed which is adapted to the shape of the contact elements and receives the contact elements individually in each case is fashioned in an elastic tube and is arranged fixedly with respect to the tube and on the side of the tube subjected to force, so that on the one hand the contact elements are mounted fixedly in the contact element bed and on the other hand the bending radius in the center axis of the chain of contacts formed by the contact elements is greater than the bending radius of the actual contact element bed. In this literature reference, it is also proposed that the contact elements may additionally have an expander cord passing through them.

This arrangement is complex, since the molding of the contact element beds of course requires expenditure on a mold and it must be ensured that the arrangement of the contact element beds and the size of the contact elements are adapted to one another in such a way that the contact elements touch one another in the state of rest.

SUMMARY

The invention is based on the object of providing a closing edge safety device with which it is to be ensured that the contact elements used, preferably balls or ball-like parts, are correctly aligned, but nevertheless respond to the slightest deforming pressure by signaling. Furthermore, the production expenditure is, however, to be kept low.

While in the case of all safety strips of the prior art considerable amounts of expenditure are devoted to providing that the contact elements, no matter whether they are designed as balls, rollers or however else, are pressed against one another at their contact zones, it is now proposed according to the invention that the contacting of the individual contact elements with one another can take place merely by the force of gravity, i.e. by the weight of the contact elements, if the safety strip is vertically aligned. It goes without saying that the contacting of the elements with one another achieved in this way is all the better the heavier the elements, but in any event the elements are of a weight which is adequate for contact-making abutment with one another when the safety strip is perpendicularly installed.

According to one aspect of the invention, it is provided that the contact elements center, themselves within a tube, which can preferably be designed as a pliable tube, by being magnetized, that is to say lying with their opposing poles against one another, and holding one another firmly, thereby producing the required pretension with which the individual contact elements touch one another in the installed state.

According to another aspect, it is proposed that the chain of balls is designed as a closed structural system, which can move about in the tube as a closed unit, since the expander cord ensures the contact, so that as a result the tube can be adapted to any desired geometrical shape and even the tightest radii can be produced if the contact elements are of a correspondingly small design, so that in automotive engineering in particular, for example when providing fuse protection for the rubber closing strip on truck lids, an undesired displacement of the balls when laying in tight curves cannot occur. Instead of the expander cored, a wire spring arrangement or the like may also be used.

According to another aspect of the invention, the contact elements are designed as simple balls.

According to a preferred embodiment, the contact elements are designed according to the invention as part-spherical balls which have peripheral contact surfaces. As a result, improved contact forming is achieved; a greater touching surface area is ensured, so that lower resistance is brought about and the centering of the contact elements is better and easier.

Furthermore, it is provided according to the invention that the contact element may in this case be constructed by using a conductive sleeve, encapsulated by a sheath of plastic. In this case, the sleeve has plane-parallel surfaces.

It is also possible for each contact element to be of a part-spherical design and beveled shape, so that laying in a curve is more easily possible as a result. By appropriate choice of the beveling, it is possible to correspond directly to the curve radius.

DESCRIPTION OF THE DRAWINGS

Exemplary embodiments of the invention are explained below with reference to the drawings, in which.

DETAILED DESCRIPTION

Figure 1:
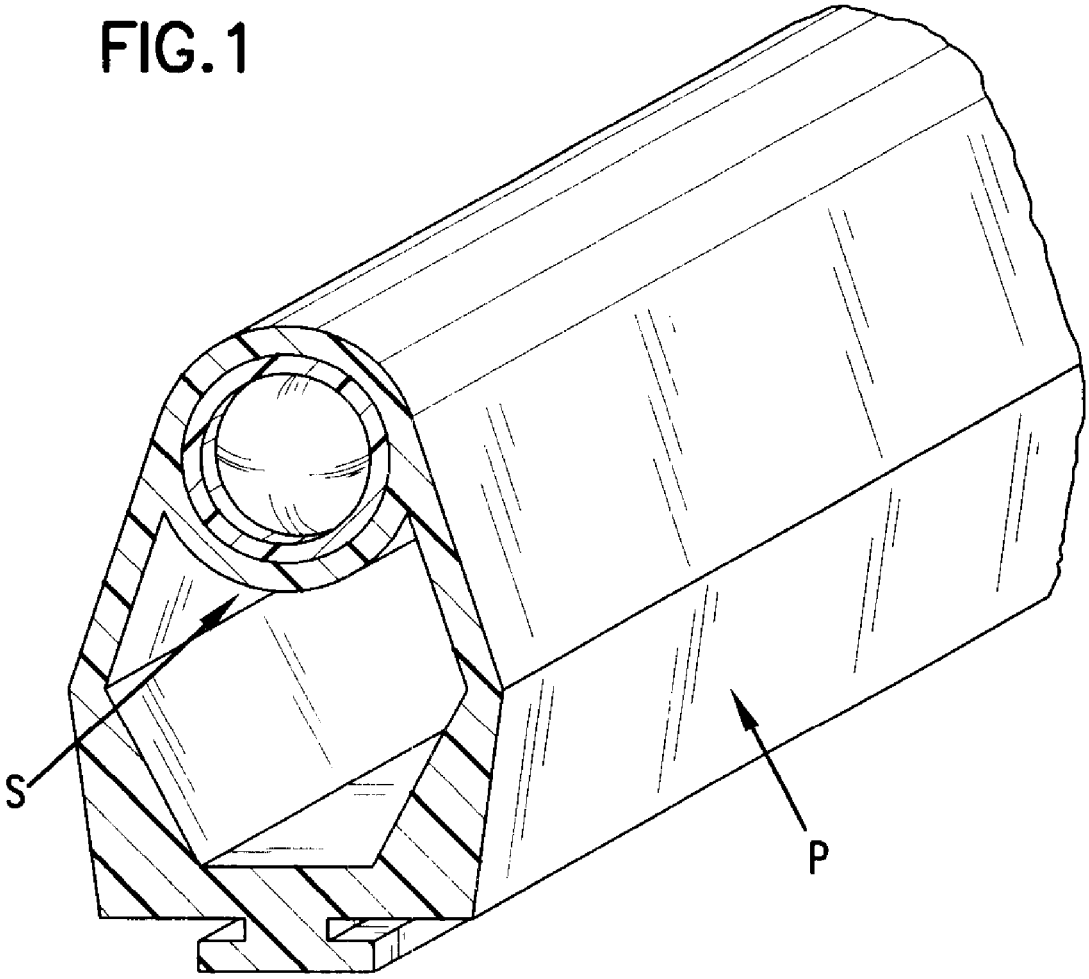
FIG. 1 shows a portion of a closing edge safety device.

Represented in FIG. 1 for better understanding of the invention is a closing edge safety device which comprises a profiled element P, which can be connected to the closing edge to be protected. This profiled element P has on its side directed toward the edge to be protected a receiving space in which a safety strip S is arranged, the design and shaping of which are the subject of the invention.

Figure 2:
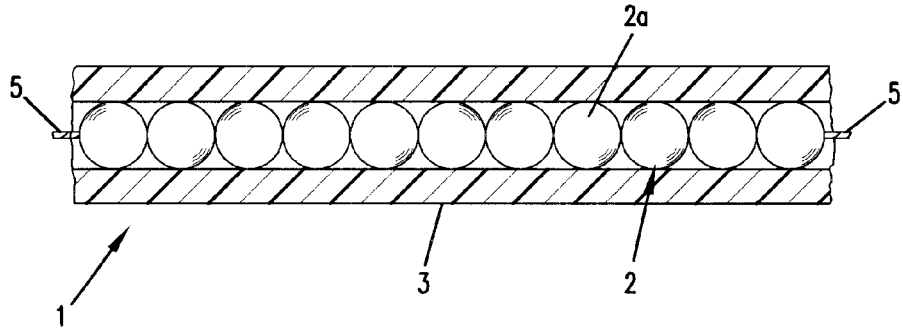
FIG. 2 shows a portion of a safety strip.

In the drawing according to FIG. 2, 1 denotes a portion of a safety strip which is formed by a tube 3 which consists of a flexible, pliable material, which may for example have a Shore hardness of between 20 and 60 Shore, preferably 40 Shore. In this case, the tube may have a soft core and a somewhat harder or more abrasion-resistant surface and is preferably produced from a thermoplastic elastomer. The tube 3 may also be formed from a sponge rubber which is provided with a corresponding covering as the surface.

Figure 3:
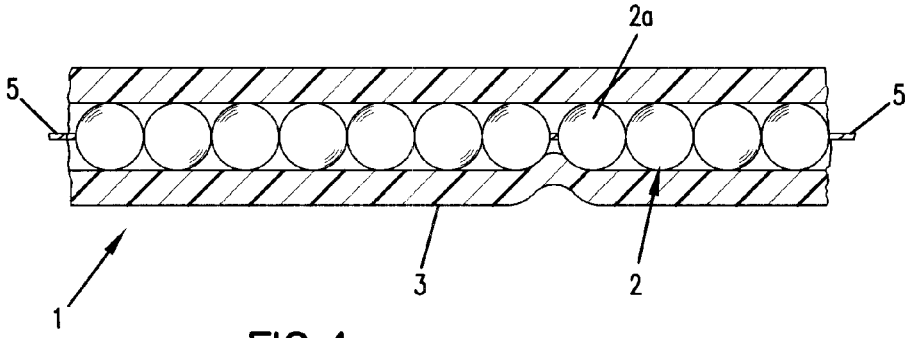
FIG. 3 shows the arrangement according to FIG. 2 when local deforming pressure occurs.

Arranged within the tube 3 are contact elements 2, which in the case of the exemplary embodiment represented according to FIGS. 2 and 3 are formed as balls 2*a*. These balls 2*a* are passed through by an expander cord 5, which presses the balls 2*a* against one another with a certain pretension at their abutting regions and, as a result, creates the pretension necessary for the effectiveness of the arrangement if the safety strip is, for example, horizontally laid. The electrical connecting contacts required in the end regions of the closing edge safety device 1 are not represented in the drawing for reasons of overall clarity and form part of the prior art.

The chain forms a closed unit and can be inserted in this form into the tube 3, but can also move about in the tube 3 if the expander cord 5 ensures the contact of the individual balls 2*a* with respect to one another, so that now tensioning of the outer sheath is not required. It is advantageous here if the inside diameter of the tube is equal to or somewhat greater than the outside diameter of the contact elements.

FIG. 3 shows that, when a local deforming pressure acts, the wall of the tube 3 facing the effect of the pressure causes the balls 2*a* to be drawn apart, whereby the closed-circuit current is interrupted and the desired signal is generated as a result.

Instead of the expander cord, which produces the pretension, this pretension is also ensured although not represented in the drawing—if the contact elements 2 are magnetized and, as a result, firmly abut one another at their touching surfaces, but are magnetized in such a way that, when the pressure occurs—as represented in FIG. 3—a release of the contact elements from one another takes place and the signaling effect is achieved as a result.

In principle, it is possible here for the inside diameter of the tube to be less than the outside diameter of the contact elements.

If the safety strip is laid perpendicularly, i.e. vertically, for example on edges of doors or the like, it appears to be possible to bring about the required pretension, which leads to the contacting of the contact elements with one another, just by the weight of the contact elements. Such an arrangement would lead to a much more cost-effective manner of production, with the same safety as the arrangements previously known in the prior art, it then being required however for the inside diameter of the tube to be greater than the outside diameter of the contact elements.

Figure 4:
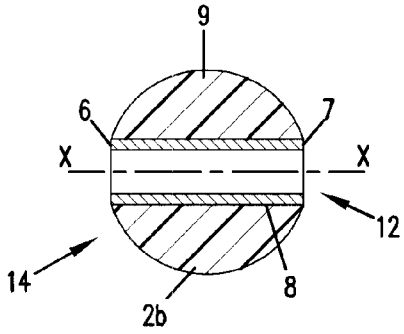
FIG. 4 shows a modified embodiment of the contact elements on a larger scale and FIG. 5 in turn shows a modified embodiment of the contact elements with beveled side edges.

In the case of the embodiment according to FIG. 4, the contact element is designed as a part-ball element 2*b*, which has touching surfaces 6 and 7, which are positioned generally about the center axis X—X and are formed on the flattened side walls 12 and 14. This arrangement creates a greater touching surface area than in the case of a normal ball, so that the electrical resistance is lower and the centering is improved. Consequently, better contact forming is achieved overall. The contact element 2*b* may in this case be constructed in such a way that a conductive sleeve 8 is provided and encapsulated with a sheath 9 of plastic. The sleeve 8 has in this case plane-parallel surfaces 6 and 7, which form the contact surfaces.

The contact element 2*b* represented in FIG. 4 may of course also be produced completely from conductive material.

Figure 5:
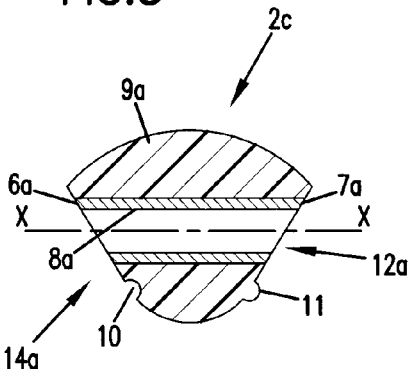

In the case of the design of the contact element 2*c* according to FIG. 5, beveled side walls 12*a* and 14*a* of the originally spherical contact element 2*c* are provided.

As a result, laying of the contact elements at an angle corresponding to the beveling is made possible, so that consequently for example small radii can be laid without the use of balls being required, with all the advantages which the relatively large touching surfaces of the arrangement according to FIG. 2 make possible being retained as a result.

In FIG. 5, the touching surfaces are denoted by 6*a* and 7*a*, the possibly provided sleeve is denoted by 8*a* and the sheath is denoted by 9*a*. The center axis X—X is depicted.

In addition, in the case of this embodiment small projections 11 and small recesses 10 corresponding to the projections may be provided, so that securement of this contact element against twisting is achieved as a result, which may be of significance with the beveled surfaces.

What is claimed is:

1. A closing edge safety device comprising a safety strip (1) which has an electrical switching device having a multiplicity of contact elements (2), arranged in series in a tube of said safety device, the contact elements (2) abutting one another in a position of rest at contact zones provided on the contact elements and moving apart under an effect of an external force causing with local deformation of the tube (3) and contact between the contact elements to be interrupted, characterized in that, the contact elements (2*b*) are part-spherical and the contact zones (6, 7) are flattened side wall surfaces (12, 14) of the contact elements.

2. The closing edge safety device as claimed in claim 1, characterized in that the flattened side wall surfaces (12*a*, 14*a*) of each of the contact elements are beveled.

3. The closing edge safety device as claimed in claim 2, characterized in that the beveled surfaces of the contact elements (2*c*) are provided with projections (11) and recesses (10).

4. The closing edge safety device as claimed in claim 1, characterized in that the contact zones (6, 7) are positioned on the contact elements such that they are positioned generally about a center axis (X—X).

5. The closing edge safety device as claimed in claim 1, characterized in that each of the contact elements (2*b*, 2*c*) has a conductive sleeve (8, 8*a*) and a sheath (9, 9*a*) of plastic.

6. The closing edge safety device as claimed in claim 1, characterized in that the contact elements (2*a*, 2*b*, 2*c*) consist completely of a conductive material.

7. The closing edge safety device as claimed in claim 1, characterized in that said tube (3) has a Shore hardness of between 60 and 20 Shore.

8. The closing edge safety device as claimed in claim 7, characterized in that the tube has a Shore hardness of 40 Shore.

9. The closing edge safety device as claimed in claim 1, characterized in an inside diameter of the tube (3) is less than an outside diameter of the contact elements.

10. The closing edge safety device as claimed in claim 1, characterized in the tube (3) has a soft inner core, while an outer surface of the rube is harder the said core and is abrasion-resistant.

11. A closing edge safety device comprising a safety strip (1) which has an electrical switching device having a multiplicity of contact elements (2), arranged in series in a tube (3) of said safety device, the contact elements (2) abutting one another in a position of rest at contact zones provided on end faces of the contact elements and moving apart under an effect of an external force, causing local deformation of the tube (3) and contact between the contact elements to be interrupted, characterized in that the contact elements (2, 2*b*, 2*c*) are magnetized which urges the contact elements to abut one another.

* * * * *